US006133880A

United States Patent [19]

Grangeat et al.

[11] Patent Number: 6,133,880

[45] Date of Patent: Oct. 17, 2000

[54] SHORT-CIRCUIT MICROSTRIP ANTENNA AND DEVICE INCLUDING THAT ANTENNA

[75] Inventors: Christophe Grangeat, Sevres; Charles Ngounou Kouam, Les Ulis; Laurence Lorcy, St Fargeau Ponthierry; Jean-Philippe Coupez, Brest; Francois Lepennec, Porspoder; Serge Toutain, Plouzane, all of France

[73] Assignee: Alcatel, Paris, France

[21] Appl. No.: 09/209,449

[22] Filed: Dec. 11, 1998

[30] Foreign Application Priority Data

Dec. 11, 1997 [FR] France ..... 9715694

[51] Int. Cl.[7] ..... H01Q 1/38

[52] U.S. Cl. ..... 343/700 MS

[58] Field of Search ..... 343/700 MS; H01Q 1/38

[56] References Cited

U.S. PATENT DOCUMENTS 5,952,975 9/1999 Pedersen et al. ..... 343/700 MS

FOREIGN PATENT DOCUMENTS 0 749 176 A1 12/1996 European Pat. Off. .

0 795 926 A2 9/1997 European Pat. Off. .

OTHER PUBLICATIONS

R. N. Simons et al., "Coplanar–Waveguide/Microstrip Probe Coupler and Applications to Antennas", Electronics Letters, vol. 26, No. 24, Nov. 22, 1990, pp. 1998–2000.

T. D. Ormiston et al., "Microstrip Short–Circuit Patch Design equations", Microwave and Optical Technology Letters, vol. 16, No. 1, Sept. 1997, pp. 12–14.

*Primary Examiner*—Michael C. Wimer

*Attorney, Agent, or Firm*—Sughrue, Mion, Zinn, Macpeak & Seas, PLLC

[57] ABSTRACT

A microstrip antenna includes a composite short-circuit consisting of two conductive strips. A vertical strip, in the plane of the short-circuit between the two strips, is connected to the central conductor of a coupling line forming part of the antenna and enabling the coupling with a resonance thereof, as for example to excite such resonance. The short-circuit and the vertical strip constitute two terminals for said antenna, enabling it to be easily connected to a signal processing units, such as a transmitter. The antenna described includes two zones enabling it to operate at two frequencies. The antenna has particular utility in portable telephones and their base stations.

5 Claims, 3 Drawing Sheets

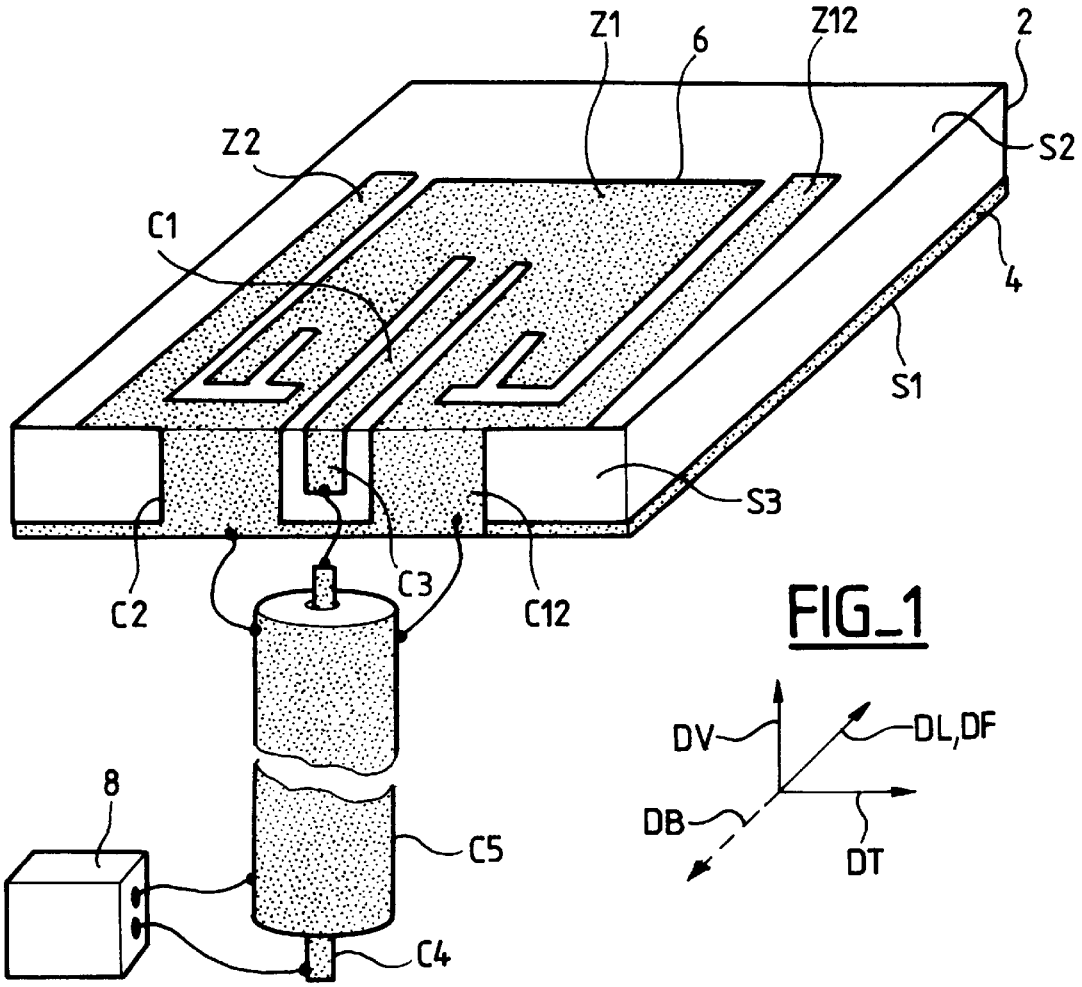
FIG_1
FIG_4
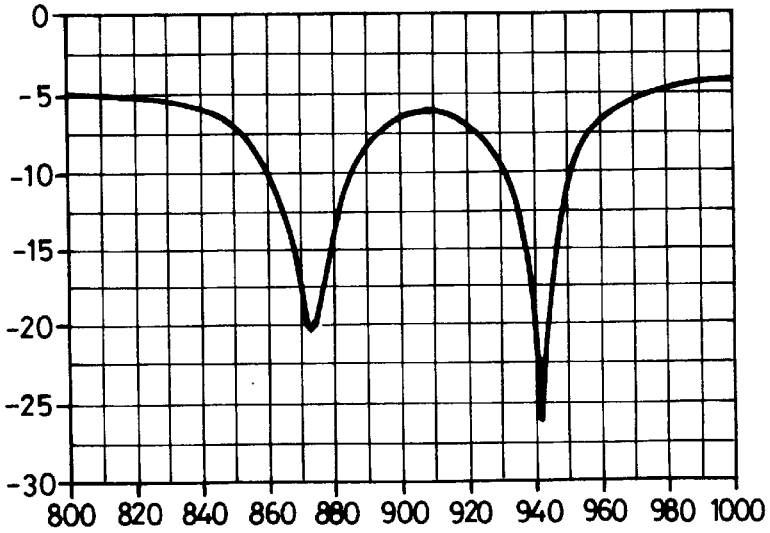

SHORT-CIRCUIT MICROSTRIP ANTENNA AND DEVICE INCLUDING THAT ANTENNA

The present invention concerns microstrip antennas.

These antennas are typically used at microwave frequencies and at radio frequencies. The antenna includes a patch that is typically obtained by etching a metallic layer. It is known as a microstrip patch antenna.

BACKGROUND OF THE INVENTION

The microstrip technique is a planar technique with applications to making signal transmission lines and to making antennas constituting a coupling between such lines and radiated waves. It employs conductive patches and/or strips formed on the top surface of a thin dielectric substrate which separates them from a conductive ground layer on the bottom surface of the substrate. A patch of the above kind is typically wider than a strip of the above kind and its shape and dimensions constitute important characteristics of the antenna. The substrate is typically in the form of a rectangular plane sheet of constant thickness. This is in no way obligatory, however. In particular, it is known that an exponential variation in the thickness of the substrate widens the bandwidth of an antenna of the above kind and that the shape of the sheet can depart from the rectangular shape. The electric field lines extend through the substrate between the strip or the patch and the ground layer. The above technique differs from various other techniques that also use conductive elements on a thin substrate, namely:

- the stripline technique in which a strip is confined between the bottom ground layer and a top ground layer which in the case of an antenna must include a slot to enable coupling with the radiated waves,
- slotted line techniques in which the electric field is established between two parts of a conductive layer formed on the top surface of the substrate and separated from each other by a slot which in the case of an antenna must typically open into a wider opening facilitating coupling with the radiated waves, for example by forming a resonant structure, and
- the coplanar line technique in which the electric field is established on the top surface of the substrate and symmetrically between a central conductive strip and two conductive areas on respective opposite sides of the strip from which they are separated by respective slots. In the case of an antenna, the strip is typically connected to a wider patch to form a resonant structure providing a coupling with the radiated waves.

With regard to the manufacture of antennas, the following description will on occasion and for simplicity be restricted to the case of a transmit antenna connected to a transmitter. It must nevertheless be understood that the arrangements described could equally apply to receive antennas connected to a receiver. With the same aim of simplicity it will be assumed that the substrate is in the form of a horizontal sheet.

Broadly speaking, a distinction can be made between two fundamental types of resonant structure that can be implemented in microstrip technology. The first type might be called a "half-wave" structure. The antenna is then a "half-wave" or "electric" antenna. Assuming that one dimension of the patch constitutes a length and extends in a longitudinal direction, the length is substantially equal to half the wavelength of an electromagnetic wave propagating in that direction in the line consisted by the ground plane, the substrate, and the patch. Coupling with the radiated waves occurs at the ends of the length, the ends being in regions where the amplitude of the electric field in the substrate is maximal.

A second type of resonant structure that can be implemented using the same technology might be called a "quarter-wave" structure. The antenna is then a "quarter-wave" or "magnetic" antenna. It differs from a half-wave antenna firstly in that its patch has a length substantially equal to one fourth of the wavelength, with the length of the patch and the wavelength being defined as above, and secondly in that there is a hard short-circuit at one end of the length between the ground plane and the patch so as to impose a quarter-wave type resonance with a node of the electric field fixed by the short-circuit. The coupling with the radiated waves occurs at the other end of the length, which is in the region in which the amplitude of the electric field through the substrate is maximal.

In practice various types of resonance can occur in such antennas. They depend in particular on:

- the configuration of the patches, which can include slots, possibly radiating slots,
- the presence and the location of any short-circuits and of electrical models representative of short-circuits, although the latter cannot always be deemed to be equivalent, even approximately, to perfect short-circuits of zero impedance, and
- coupling devices included in such antennas for coupling their resonant structures to a signal processing unit such as a transmitter, and the location of such devices.

For a given antenna configuration there may be more than one resonant mode enabling use of the antenna at a plurality of frequencies corresponding to the resonant modes.

An antenna of the above kind is typically coupled to a signal processing unit such as a transmitter not only by means of a coupling device included in the antenna but also by means of a connecting line external to the antenna and connecting the coupling device to the signal processing unit. Considering an overall functional system including the signal processing unit, the connecting line, the coupling device, and the resonant structure, the coupling device and the connecting line must be made so that the system has a uniform impedance throughout its length, which avoids spurious reflections opposing good coupling.

In the case of a transmit antenna having a resonant structure, the respective functions of the coupling device, of the connecting line, and of the antenna are as follows: the function of the connecting line is to transport a radio frequency or microwave frequency signal from the transmitter to the terminals of the antenna. All along a line of the above kind the signal propagates in the form of a traveling wave without any significant modification of its characteristics, at least in theory. The function of the coupling device is to convert the signal supplied by the connecting line to a form in which it can excite resonance of the antenna, i.e. the energy of the traveling wave carrying the signal must be transferred to a standing wave established in the antenna with characteristics defined by the antenna. As for the antenna, it transfers energy from the standing wave to a wave that is radiated into space. The signal supplied by the transmitter is therefore converted a first time from the form of a traveling wave to that of a standing wave and then a second time to the form of a radiated wave. In the case of a receive antenna the signal takes the same forms in the same units but the conversions are carried out in the opposite direction and in the reverse order.

The connecting lines can be implemented in a non-planar technology, for example in the form of coaxial lines.

Planar technology antennas are used in various types of equipment. They include mobile telephones, base stations for mobile telephones, automobiles, aircraft, and missiles. In the case of a mobile telephone, the continuous nature of the bottom ground layer of the antenna means that the radiated power intercepted by the body of the user of the device is easily limited. In the case of automobiles, and above all in the case of an aircraft or a missile whose outside surface is a metal surface and has a curved profile to minimize drag, the antenna can be conformed to that profile so as not to generate any unwanted additional drag.

The present invention is more particularly concerned with quarter-wave antennas with small dimensions.

A first quarter-wave microstrip antenna is described in the article by T. D. Ormiston, P. Gardner and P. S. Hall "Microstrip Short-Circuit Patch Design Equations", Microwave and Optical Technology Letters, vol. 16, No. 1, September 1997, pages 12–14.

In FIG. 1 of the above article, the substrate and the ground layer of the antenna are not shown, but the presence of a substrate and a ground layer under the patch and the microstrip shown is implied. To impose quarter-wave resonance on the antenna one edge of the patch is provided with a short-circuit formed in a conductive layer on an edge surface of the substrate. The short-circuit is a composite one, i.e. it comprises two conductors in the form of vertical strips. The strips extend laterally to respective ends of the width of the patch with an axial gap between them.

The article describes means for feeding the antenna from a transmitter. They are designated by the term "microstrip", i.e. they employ the microstrip technology. Although it is not explained in the article, it is clear that the microstrip means provide the two above-specified functions of the coupling device and of the connecting line. FIG. 1 of the article shows that the connecting line is a standard microstrip line. A main conductor of the line is a strip shown to be in the plane of the patch. A ground conductor of the line is part of the ground layer, not shown, common to the line, to the coupling device, and to the antenna.

As for the coupling device, it is in the form of a horizontal longitudinal strip. It is shown as part of a microstrip line extending the strip of the connecting line. This strip might be called the coupling strip. It enters the area of the patch via the edge of the short-circuit. It then extends into that area from the edge between two notches and is connected to the patch at a connection point internal to the patch, i.e. at a point inside the area of the patch. According to the article, the two notches are provided to enable the coupling strip to penetrate as far as the appropriate connection point. They correspond to the two edges of the axial gap of the short-circuit.

This first prior art antenna has the following drawbacks:

A first drawback relates to the fact that the strip and the ground of the connecting line are respectively in line with the patch and with the ground of the antenna. At least in some small devices such as some mobile phones, the components of the transmitter are inside the unit including the antenna and the antenna is on the surface of the device, the components typically being grouped together on a printed circuit board called the "mother board". As a result the connecting line described in the above article cannot on its own connect the antenna to the transmitter. An additional connecting line must be provided and installing two such lines in a device of the above kind increases its manufacturing cost.

Another drawback of the above antenna is that it can be fed, or more generally coupled to the signal processing unit, only when various parameters are adjusted precisely. These parameters include the width and the length of the two notches mentioned above and the width of the coupling strip, and they must be adjusted to obtain a suitable value of the impedance of the antenna. Their values, and more particularly the Length, must be kept within very close tolerances that are difficult to determine in advance. In the case of industrial mass production of such antennas, this adjustment problem can increase manufacturing costs unacceptably.

A second quarter-wave microstrip antenna is described in patent document WO 94/24723 (Wireless Access Inc). Its patch (316 in FIG. 3) has a wide slot (rectangular ring 350) to make it less sensitive to the proximity of conductive masses such as a human body or electrical circuits such as those of a microcomputer. Its short-circuit (330) is partial in the sense that it is formed by only a segment of one edge of the patch. It is stated that this facilitates matching the input impedance of the antenna. The connecting line feeding the antenna is disposed vertically under the substrate. It is of the coaxial type. The coupling device is an extension of the central conductor, i.e. of the main conductor that extends along the axis of the line, the extension passing through the substrate in order to be connected to the patch. The ground conductor that sheathes the line is connected directly to the antenna ground.

The second prior art antenna has the drawback that providing an efficient coupling device using the terminal part of the central conductor of a coaxial line connected to the antenna patch requires a hole through the substrate and leads to practical difficulties, in particular with adjusting the position of the connection point. These problems increase the cost of manufacture, especially in the case of mass production.

Patent Application EP 0 795 926 describes an antenna having:

- two parallel dielectric layers each having a bottom surface, a top surface and an edge surface,
- a conductive ground plane under the bottom surface of the bottom dielectric layer,
- a conductive patch extending between the two dielectric layers and having two ends folded over onto the top face of the top dielectric layer, this antenna being similar to a cavity radiating through two lateral openings,
- two short-circuit conductors on the edge surface of the bottom dielectric layer connecting the patch two the ground plane, and
- connecting conductors for transmitting a signal between the antenna and a signal processing unit.

The connecting conductors include a first microstrip waveguide on the top face of the bottom dielectric layer, by virtue of the fact that is formed by a cut-out in the patch. In a first embodiment the first microstrip waveguide is connected to a coaxial cable below the ground plane by a conductive strip very much narrower than the first guide on the edge surface of the bottom dielectric layer.

In a second embodiment the coaxial cable is replaced by a second microstrip waveguide in the ground plane, on the bottom surface of the bottom dielectric layer, if it is designed like a printed circuit board.

The above antenna has the disadvantage of a non-negligible impedance discontinuity at the connection between the first waveguide and the coaxial cable or the second microstrip waveguide.

OBJECTS AND SUMMARY OF THE INVENTION

The aims of the present invention include:

facilitating the coupling between a short-circuit antenna of the above kind and a signal processing unit such as a transmitter that has to cooperate with the antenna, and limiting the cost of manufacture of a communication device including an antenna of the above kind and a signal processing unit, especially in the case of mass production of a device of the above kind.

With the above aims in view, the present invention consists in a microstrip antenna including:

a dielectric substrate having a bottom surface, a top surface and an edge surface, a conductive ground plane on said bottom surface, a conductive patch on said top surface, two short-circuit conductors on said edge surface and connecting said patch to said conductive ground, and connecting conductors for transmitting a signal between said antenna and a signal processing unit; wherein the connecting conductors include a coplanar line having a first section on the top face of the substrate and a second section on the edge surface and extending the first section with no significant impedance discontinuity.

BRIEF DESCRIPTION OF THE DRAWINGS

Various aspects of the present invention are explained with the aid of the following description and the accompanying diagrammatic drawings. If the same item is shown in more than one of the figures it is designated by the same reference numerals and/or letters.

FIG. 1 is a perspective view of a communication device including a first antenna in accordance with the present invention.

FIG. 4 is a diagram showing the variation in a reflection coefficient at the input of the same antenna in decibels as a function of the frequency in MHz.

MORE DETAILED DESCRIPTION

Figure 2:
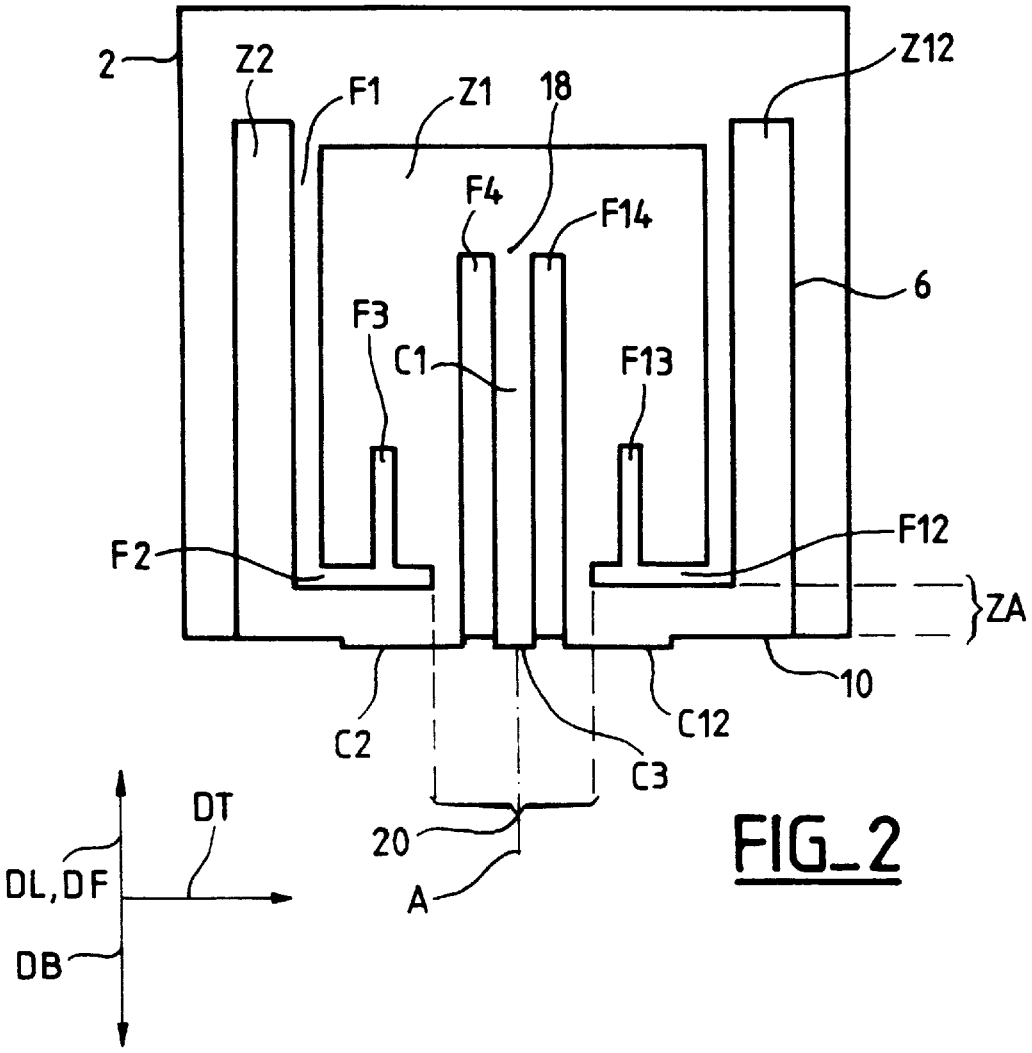
FIG. 2 is a top view of the antenna from FIG. 1.
Figure 3:
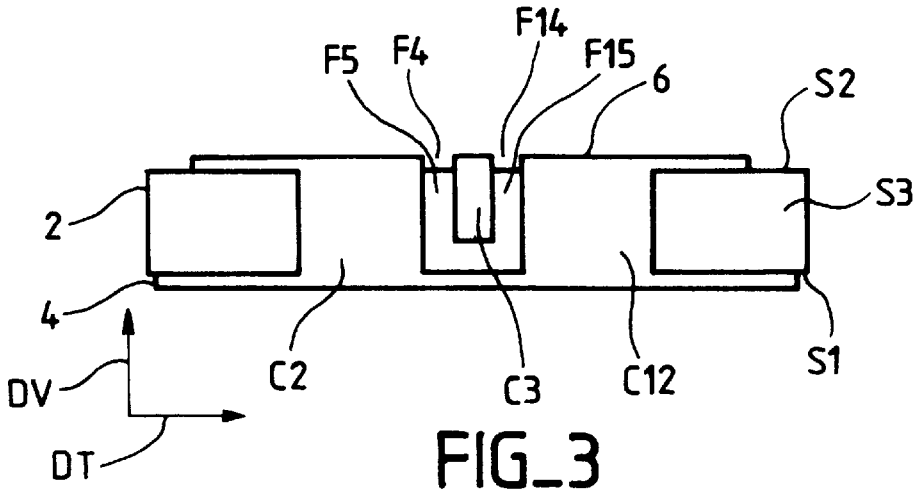
FIG. 3 is a front view of the same antenna.

Like the first above-mentioned prior art antenna, an antenna in accordance with the present invention has a resonant structure made up of the following components:

A dielectric substrate 2 having two mutually opposed main surfaces extending in directions defined in the antenna and constituting horizontal directions DL and DT, these directions possibly depending on the area of the antenna concerned. As previously explained the substrate can have various shapes. Its two main surfaces are respectively a bottom surface S1 and a top surface S2. Another direction is also defined in the antenna. It is at an angle to each of the horizontal directions and constitutes a vertical direction DV. The angle just referred to is typically a right angle. However, the vertical direction can also be at different angles to the horizontal directions and can also depend on the area of the antenna concerned. The substrate has several edge surfaces, like the surface S3, each of which connects an edge of the bottom surface to a corresponding edge of the top surface and contains the vertical direction.

A bottom conductive layer extending over the bottom surface and constituting an antenna ground 4.

A top conductive layer extending over an area of the top surface above the ground 4 to constitute a patch 6. The patch has a configuration specific to the antenna. It also has a length and a width in two of said horizontal directions constituting a longitudinal direction DL and a transverse direction DT, respectively, the latter direction being parallel to the edge surface S3. Although the words length and width usually apply to two mutually perpendicular dimensions of a rectangular object, the length being greater than the width, it must be understood that the patch 6 can depart from that kind of shape without departing from the scope of the invention. In particular, the directions DL and DT can be at an angle other than 90 degrees, the edges of the patch need not be rectilinear and its length can be less than its width. One edge is at the intersection of the top surface S2 and the edge surface S3. It therefore extends in the transverse direction DT. It constitutes a rear edge 10 and defines one way DB in the longitudinal direction DL towards the rear edge and an opposite way DF towards the front.

Finally, in the first antenna in accordance with the present invention, a short-circuit C2 electrically connecting the patch 6 to the ground 4. The short-circuit is formed in the edge surface S3 which is typically plane and which then constitutes a short-circuit plane. It imposes an at least approximately quarter-wave type antenna resonance.

The antenna further includes a coupling device in the form of a coupling line. The device includes a main conductor consisting of two sections C1 and C3 connected to the patch 6 at an internal connection point 18. It further includes a composite ground conductor that cooperates with the main conductor and is described below. It constitutes all or part of a connection system that connects the resonant structure of the antenna to a signal processing unit 8, for example to excite one or more antenna resonances from that unit in the case of a transmit antenna. In addition to this device the connection system typically includes a connection line C4, C5 external to the antenna and including two conductors. At an antenna end of this line the two conductors are connected to respective connecting conductors that are part of the coupling device and which can be considered to form two terminals of the antenna. At the other end of the line its two conductors are respectively connected to two terminals of the signal processing unit. The line can be of the coaxial type, of the microstrip type or of the coplanar type. If the antenna concerned is a receive antenna, the same system transmits the signals received by the antenna to the signal processing unit. The various components of the system have the functions previously defined.

The present invention also consists in a communication device including an antenna in accordance with the present invention and a signal processing unit of the above kind connected to the antenna by a connection system of the above kind.

The antenna in accordance with the present invention can be a single-frequency antenna or a multi-frequency antenna. The antenna of the example is a dual-frequency antenna, i.e. it must give rise to at least two resonances so that it can operate in two modes corresponding to two operating frequencies. To this end a slot formed in the patch 6 opens towards the front and outside the patch. It constitutes a longitudinal separator slot F1. The longitudinal extent of this slot defines in the patch a front region Z2, Z1, Z12 in which the slot divides a primary zone Z1 from a secondary zone Z2. A rear region ZA extends between the front region and the rear edge 10. The rear region is much shorter in the longitudinal direction DL than the front region.

The internal connection point 18 is in the primary zone Z1. One operating mode of the antenna then constitutes a primary mode in which a standing wave is established by virtue of propagation of traveling waves both ways in the longitudinal direction or a direction near the longitudinal direction, the waves propagating in an area including the primary zone and the rear region and substantially excluding the secondary zone Z2. Another operating mode constitutes a secondary mode in which a standing wave is established by virtue of propagation of traveling waves both ways (the same as before) in another area including the primary and secondary zones and the rear region.

In the context of this arrangement the rear region ZA has a first function of coupling the secondary zone to the primary zone to enable the secondary mode to be established. It has a second function of enabling the short-circuit on the rear edge to exercise its role in each of these two zones. The antenna is then a quarter-wave antenna, at least approximately, for each operating frequency.

The configurations of the patch and of the coupling line and more particularly the longitudinal position of the internal connection point 18 are chosen to obtain a required predetermined value of the impedance presented by the antenna to the signal processing unit or more typically of a connecting line connecting that unit to the device. This impedance is referred to as the antenna impedance hereinafter. In the case of a transmit antenna it is usually called the input impedance. Its required value is advantageously equal to the impedance of the connecting line. This is why the position of the connection point preferably gives substantially the same antenna impedance value for the various operating frequencies.

It is generally beneficial for the operating frequencies to have predetermined required values. These values can advantageously be obtained by an appropriate choice of the respective longitudinal dimensions of the primary zone Z1 and the secondary zone Z2. This is why these two dimensions are typically different.

In the case more particularly described here the configuration of the patch 16 also forms a slot extending in the transverse direction DT. This slot constitutes a transverse separator slot F2 partly separating the primary zone from the rear region ZA. It is connected to the rear end of the longitudinal separator slot F1. Another slot F3 in the primary zone Z1 extends towards the front from the transverse separator slot F2. It might be called the frequency reducing slot because its role is to reduce the operating frequencies as its length increases. Thus it not only limits the length of the patch necessary to obtain predetermined required values of the operating frequencies but also enables those frequencies to be adjusted by appropriately adjusting its length.

The antenna preferably has a plane of symmetry extending in the longitudinal directional DL and the vertical direction DV, the trace of this plane in the top surface of the substrate constituting an axis of symmetry A of the patch 6. If two components are symmetrical to each other about the axis or plane of symmetry the number included in the reference symbols for that on the right in the figures is equal to the corresponding number for that on the left increased by 10. The coupling device and the primary zone Z1 extend to the vicinity of the axis A and the configuration of the patch forms said two longitudinal separator slots F1, F11 on respective opposite sides of the primary zone. The secondary zone then includes two parts Z2, Z12 beyond the respective slot.

Given the above, the set of separator slots F1, F2, F11, F12 is U-shaped. The branches and the base of the U are respectively longitudinal and transverse. The base has an axial gap 20 extending either side of the axis for connecting the primary zone Z1 to the short-circuit C2, C12 by means of an axial part of the rear region ZA.

In accordance with an advantageous arrangement already used in the first prior art antenna previously mentioned, the coupling line that constitutes the coupling device of the antenna includes a conductor that is part of the top conductive layer. To be more precise, a section C1 of said main conductor enters the area of the patch 6 in the longitudinal direction DL. It extends between a rear end near the rear edge 10 and a front end consisting of the internal connection point 18. This main conductor section is in the form of a strip and might be called the horizontal coupling strip.

As in the case of the first prior art antenna previously mentioned, the strip is limited laterally by two notches F4 and F14. However, in the antenna of the present invention the two notches F4 and F14 are sufficiently narrow in the direction DT and sufficiently long in the direction DL to be respectively regarded as two longitudinal slots F4 and F14. The two slots separate the strip from the patch 6 and are referred to as coupling slots hereinafter. Their width allows for the fact that the parameters of the line of which the coupling strip constitutes the main conductor can advantageously be determined in designing the line as a coplanar line adapted to excite the antenna in a distributed fashion along the length of the line rather than as a microstrip line adapted to excite the antenna only at the end of the line.

The ground conductor of the coplanar line then consists primarily, like a coplanar line, of the parts of the patch 6 on respective opposite lateral sides of the strip C1 beyond the two slots F4 and F14 and not of the is antenna ground as in a microstrip line. This line is referred to hereinafter as the horizontal coplanar line.

It would enable the antenna to be coupled by means of an electromagnetic signal applied to or picked up by the external connection line at the rear end of the horizontal coplanar line between two terminals common to the horizontal coplanar line and the antenna, the two terminals respectively comprising the ground conductor 4 of the line and the rear end of the strip C1. However, at least in the case of devices such as certain mobile telephones, making the connection between the coupling device and the external line by means of conductors of this kind in the plane of the patch would complicate the manufacture of the device.

In particular, the horizontal coplanar line in question extends along the axis A. It enters the axial gap 20 at the base of the U, this gap being delimited by the two coupling slots F4 and F14. As previously mentioned, the position of the front end 18 of its main conductor is determined to obtain a required value of the antenna impedance. However, the antenna impedance depends also on other parameters such as the widths of the coupling strip C1 and of the coupling slots and on the nature of the substrate.

In accordance with another advantageous feature previously employed in the first prior art antenna, said short-circuit is a composite short-circuit comprising two short-circuit conductors C2 and C12. The two conductors extend in the vertical direction DV with a gap between them. Each of them connects the antenna ground 4 to the patch 6.

In an arrangement specific to the present invention the antenna coupling line further includes connecting conductors that are formed on the edge surface S3 and which can form a vertical coplanar line. A line of this kind is more particularly made up of the following conductors:

A main conductor C3 extending in the vertical direction DV between a bottom end and a top end in the gap left between the two short-circuit conductors C2 and C12. The top end is connected to the rear end of the main conductor C1 of the horizontal coplanar line. The main conductor of the vertical coplanar line simultaneously constitutes said first connecting conductor, a first terminal of the antenna and a vertical section of the main conductor of the coupling line.

Two ground conductors C2 and C12 co-operating with The conductor C3 and consisting of the two short-circuit conductors C2 and C12.

The two short-circuit conductors also together constitute a second terminal of the antenna. The vertical conductor C3 of the coupling line is the same width as the horizontal conductor C1 and is separated from the short-circuit conductors C2 and C12 by respective slots F5 and F15 the same width as the slots F4 and F14 so that the vertical line section constitutes a vertical coplanar line connected to the horizontal coplanar line with no significant impedance discontinuity.

In the case of a device with limited dimensions, the fact that the connecting conductors are formed on the edge surface S3 significantly facilitates making a connection between the coupling device which is part of the antenna formed on the surface of the device and a connecting line connecting the device to a signal processing unit. If the unit is inside the device the line can take the form of a coaxial line which in the vicinity of the antenna is perpendicular to the plane of the antenna. In other cases this arrangement of the connecting conductors facilitates connecting the antenna to conductors carried by a mother board to one face of which the substrate of the antenna has previously been fixed, the connecting line typically then being parallel to the longitudinal direction of the antenna, at least in is the vicinity of the antenna.

Forming connecting conductors of this kind adapted to form terminals of the antenna on the edge surface of the substrate complicates the manufacture of the antenna to only a negligible degree. The short-circuit conductors are required for the antenna as manufactured to be of the quarter-wave type. The first connecting conductor can be formed by a process at least similar to that used for the short-circuit conductors and in most cases during the same fabrication step.

More particularly, in an advantageous arrangement specific to the first example antenna all the connecting conductors of the coupling device are made collectively by the following steps:

forming a vertical conductive layer on the edge surface S3, and etching this layer to form the two short-circuit conductors C2 and C12 and the first connecting conductor C3 simultaneously. The conductors then constitute two short-circuit strips and a vertical coupling strip, respectively.

The connecting conductors preferably occupy only a fraction of the rear edge 10. In the example antenna this is substantially the same fraction as the primary zone Z1.

The widths of the coupling strips and the slots such as the coupling slots on respective opposite sides of the strips are preferably chosen to obtain a uniform and suitable impedance, which is typically 50 ohms, for the coupling line consisting of the vertical and horizontal coplanar lines. The antenna impedance is adjusted by choosing the position of the internal connection point 18. The narrow widths of the coupling slots and the resulting lateral coupling effect make it possible to widen the manufacturing tolerance in respect of the various parameters without compromising good coupling quality.

In the case of the first example antenna, which is intended to be used in a device with small dimensions, the connecting line external to the antenna is a coaxial line. At least in the vicinity of the antenna it typically extends in a direction substantially perpendicular to the surface of the antenna, for example in the vertical direction DV. It includes an axial conductor C4. At a first end of the line the axial conductor is connected to the conductor C3. At the other end of the line it is connected to a first terminal of the signal processing unit 8. Along the length of the line it is surrounded by a conductive sheath C5. At the first end of the line the sheath is connected to both short-circuit conductors C2 and C12. At the other end of the line it is connected to the other terminal of the signal processing unit 8, which is a transmitter, for example.

In the context of one embodiment of the first antenna, various compositions and values are given below by way of numerical example. The lengths and widths are respectively indicated in the longitudinal direction DL and the transverse direction DT.

primary operating frequency: 940 MHz, secondary operating frequency: 870 MHz, input impedance: 50 ohms, composition and thickness of substrate: epoxy resin having a relative permittivity $e_r$=4.3 and a dissipation factor tan d=0.02, thickness 1.6 mm, composition and thickness of conductive layers: copper, 17 microns, length of primary zone Z1: 26 mm, width of zone Z1: 29 mm, length of secondary zones Z2 and Z12: 30 mm, width of each of these zones: 5.5 mm, length of rear region Z3: 2.5 mm, length of conductor C1 of horizontal coplanar line: 25 mm, width of conductor C1 and main conductor C3 of vertical coplanar line: 2.1 mm, height of conductor C3: 0.8 mm, common width of all slots, in horizontal direction for transverse slots F2 and F12: 0.5 mm, length of frequency reducing slots F3 and F13: 5 mm, width of axial gap 20: 7 mm, width of each short-circuit conductor C2 and C12: 5 mm.

Figure 5:
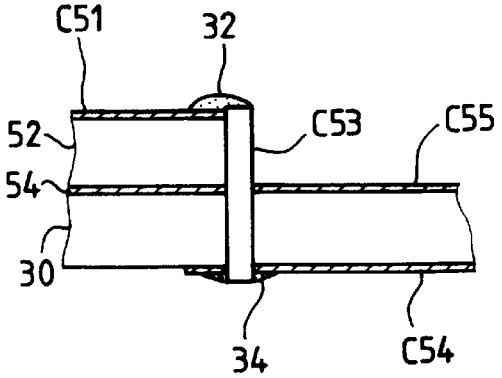
FIG. 5 shows part of a second antenna in accordance with the present invention in section on a vertical plane.
Figure 6:
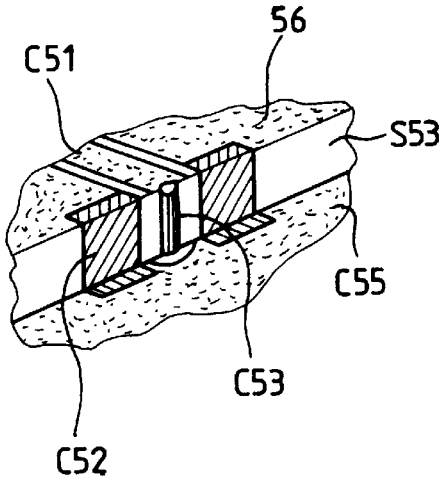
FIG. 6 is a partial perspective view of the antenna from FIG. 5.

FIGS. 5 and 6 show an external connecting line and an antenna coupling line for a second antenna n accordance with the present invention.

Various components of the second antenna are respectively analogous, at least as regards their function, to various components of the first antenna previously described. Such components are designated by the same reference letters and/or numbers as the analogous components of the first antenna except that the numbers are increased by 50, the ground conductor C5 of the external connecting line of the first antenna being analogous to a conductor C55 of the second antenna, for example.

The second antenna differs from the first in the following respects:

The main conductor C54 and the ground C55 of the external connecting line are formed on the bottom and top surfaces of a dielectric sheet 30 constituting a mother board and carrying the components (not shown) of a signal processing unit (also not shown). The line is a microstrip line. A layer constituting its ground and that of the mother board is an extension of the ground 54 of the antenna. The substrate 52 of the antenna is fixed to the top surface of the mother board 30. The main conductor of the vertical coupling line, i.e. said first connecting conductor, is in the form of a metal cylinder C53 passing through the mother board 30. It is connected by two welds 32 and 34 to the horizontal coupling strip C51 and to the strip 54 of the external connecting line. The two short-circuit conductors C52 and C62 are in the form of two preconstituted metal strips applied to the top face of the substrate 52, to its edge surface S53 and to the ground C55 of the mother board 30.

Other ways of connecting an antenna fixed flat to a mother board are possible, of course.

What is claimed is:

1. A microstrip antenna including:

a dielectric substrate having a bottom surface, a top surface and an edge surface, a conductive ground plane on said bottom surface, a conductive patch on said top surface, two short-circuit conductors on said edge surface and connecting said patch to said conductive ground, and connecting conductors for transmitting a signal between said antenna and a signal processing unit;

wherein the connecting conductors include a coplanar line having a first section on the top face of the substrate and a second section on the edge surface and extending the first section with no significant impedance discontinuity, and wherein the antenna is symmetrical about a plane passing through an axis of symmetry of said patch in a vertical direction that is contained with the edge surface.

2. An antenna according to claim 1, including a resonant structure including:

said dielectric substrate, said substrate having two mutually opposed main surfaces extending in directions defined in said antenna and constituting horizontal directions, said two surfaces respectively constituting said bottom surface and said top surface, another direction being further defined in said antenna at an angle to each of said horizontal directions, said other direction constituting said vertical direction, a conductive bottom layer on said bottom surface and constituting said ground of said antenna, a conductive top layer on an area of said top surface above said ground to constitute said patch, said patch having a configuration, edges, a length and a width, said length and said width extending in two of said horizontal directions constituting a longitudinal direction and a transverse direction, respectively, said edge surface further containing an edge of said patch, said edge extending an said transverse direction, and said short-circuit conductors extending in said vertical direction and imposing at least approximately on said resonant structure a quarter-wave type resonance, said antenna further including a coupling line adapted to couple a traveling wave propagating in said line and said resonance of the resonant structure, said line including:

a main conductor connected to said patch at an internal connecting point, and a ground conductor parallel to and alongside said main conductor, wherein said main conductor of the coupling line includes a vertical section alongside said short-circuit conductors and constituting a first connecting conductor, said ground conductor of said line including a vertical section consisting of said short-circuit conductors to enable said resonant structure to be connected to said signal processing unit by means of a vertical line including said vertical sections of said conductors forming part of said coupling line.

3. A microstrip antenna including:

a dielectric substrate having a bottom surface, a top surface and an edge surface, a conductive ground plane on said bottom surface, a conductive patch on said top surface, two short-circuit conductors on said edge surface and connecting said patch to said conductive ground, and connecting conductors for transmitting a signal between said antenna and a signal processing unit;

wherein the connecting conductors include a coplanar line having a first section on the top face of the substrate and a second section on the edge surface and extending the first section with no significant impedance discontinuity;

including a resonant structure including:

said dielectric substrate, said substrate having two mutually opposed main surfaces extending in directions defined in said antenna and constituting horizontal directions, said two surfaces respectively constituting said bottom surface and said top surface, another direction being further defined in said antenna at an angle to each of said horizontal directions, said other direction constituting a vertical direction, said edge surface containing said vertical direction, a conductive bottom layer on said bottom surface and constituting said ground of said antenna, a conductive top layer on an area of said top surface above said ground to constitute said patch, said patch having a configuration, edges, a length and a width, said length and said width extending in two of said horizontal directions constituting a longitudinal direction and a transverse direction, respectively, said edge surface further containing an edge of said patch, said edge extending in said transverse direction, and said short-circuit conductors extending in said vertical direction and imposing at least approximately on said resonant structure a quarter-wave type resonance, said antenna further including a coupling line adapted to couple a traveling wave propagating in said line and said resonance of the resonant structure, said line including:

a main conductor connected to said patch at an internal connecting point, and a ground conductor parallel to and alongside said main conductor, wherein said main conductor of the coupling line includes a vertical section alongside said short-circuit conductors and constituting a first connecting conductor, said ground conductor of said line including a vertical section consisting of said short-circuit conductors to enable said resonant structure to be connected to said signal processing unit by means of a vertical line including said vertical sections of said conductors forming part of said coupling line, wherein said main conductor of the coupling line further includes a horizontal coupling strip formed in said top conductive layer and extending in said longitudinal direction to connect said vertical section of said conductor to said internal connecting point, said horizontal coupling strip being separated from said patch by two longitudinal lateral slots on respective edges of said strip, said ground conductor of said line further including a horizontal section consisting of said patch on either side of said coupling strip, said horizontal coupling strip and said horizontal section of the main conductor constituting a horizontal coplanar line, said antenna including a vertical conductive layer on areas of said edge surface, said short-circuit being a composite short-circuit including two of said short-circuit conductors, said two short-circuit conductors comprising two vertical short-circuit strips forming part of said vertical conductive layer on respective opposite sides of said vertical section of the main conductor of the coupling line which comprises a vertical coupling strip which is also part of said vertical conductive layer and is separated from said two short-circuit conductors by respective vertical lateral slots so that said vertical line section constitutes a vertical coplanar line connected to said horizontal coplanar line with no significant impedance discontinuity.

4. An antenna according to claim 3, wherein said vertical coplanar line is formed over only a fraction of said width of the patch.

5. A radio communication device including:

an antenna according to claim 1, and a signal processing unit connected to said antenna by said connecting conductors.

* * * * *